US005752764A

United States Patent [19]

Shiau

[11] Patent Number: 5,752,764

[45] Date of Patent: May 19, 1998

[54] FLASHLIGHT HAVING A SWITCH MECHANISM MOUNTED TO A REAR END THEREOF

[76] Inventor: Shoei-Shuh Shiau, No. 10, Alley 1, Lane 551, Sec. 1, Wan-Shou Rd., Guei-Shan Hsiang, Tao-Yuan Hsien, Taiwan

[21] Appl. No.: 756,261

[22] Filed: Nov. 25, 1996

[51] Int. Cl.[6] ..... F21L 1/00

[52] U.S. Cl. ..... 362/206; 362/202; 200/60; 200/526

[58] Field of Search ..... 200/60, 526, 528; 362/157, 202–206, 208

[56] References Cited

U.S. PATENT DOCUMENTS

| | | | |
|---|---|---|---|
| 4,827,385 | 5/1989 | Gammache | 362/206 |
| 4,939,628 | 7/1990 | Wang | 362/206 |
| 4,956,755 | 9/1990 | Maglica et al. | 362/206 |

*Primary Examiner*—Alan Cariaso

*Attorney, Agent, or Firm*—Darby & Darby

[57] ABSTRACT

A flashlight includes a cylindrical tube with front and rear ends, and a switch mechanism. The switch mechanism has an end cap, a contact member, a plunger cylinder, a driving assembly, a depressing assembly, and a retainer. The end cap is threadedly engaged in the rear end of the cylindrical tube. The contact member has an annular portion disposed between the plunger cylinder and the retainer, and a number of leg portions which are connected electrically with the end cap. The plunger cylinder has a front threaded portion which engages a front threaded portion of the end cap. The driving assembly is connected with the depressing assembly and is received slidably in the plunger cylinder. The retainer is connected to the front threaded portion of the end cap. A spring member is retained in the retainer and has a front section which extends out of the retainer and a rear section which engages the contact member and the driving assembly. By operating the depressing assembly, the driving assembly is pushed to permit engagement and disengagement of the spring member and the contact member in order to turn on and turn off the flashlight.

7 Claims, 7 Drawing Sheets

FLASHLIGHT HAVING A SWITCH MECHANISM MOUNTED TO A REAR END THEREOF

BACKGROUND OF THE INVENTION

1. Field of the Invention

This invention relates to a flashlight, more particularly to a flashlight having a switch mechanism mounted to a rear end thereof.

2. Description of the Related Art

U.S. Pat. No. 4,939,628 discloses a conventional switch mechanism for a flashlight. Referring to FIG. 1, the conventional switch mechanism is shown to comprise a spring 11, a contact element 12, an annular ring 13, an end cap 15 threadedly engaged in a rear end of a cylindrical tube 14, a plunger 18 and a button 16. The annular ring 13 is retained in the end cap 15 by means of protrusions 132 formed on the outer peripheral surface thereof. The spring 11 biases the batteries away from the conventional switch mechanism and biases the contact element 12 to contact electrically the annular ring 13, as shown in FIGS. 2 and 3. By depressing the button 16, the plunger 18 is pushed against the contact member 12 to overcome the biasing force of the spring 11 so that the contact element 12 is pushed away from the annular ring 13, as best illustrated in FIGS. 4, 5 and 6. The flashlight is thus shut off.

The conventional switch mechanism suffers from the following disadvantages:

1. When the contact element 12 is moved reciprocally in the end cap 15 in order to turn on and turn off the flashlight, the axis of the tubular portion 121 of the contact element 12 is liable to offset from the axis of the end cap 15, thereby resulting in an undesired electrical contact between the tubular portion 121 and the annular ring 13, or the enlarged portion 122 of the contact element 12 and the internal wall face of the end cap 15. The undesired electrical contact prevent shutting off the flashlight.
2. The conventional switch mechanism cannot be operated to turn on and turn off the flashlight without the presence of the other components of the flashlight. That is, the spring 11 cannot bias the contact element 12 to contact the annular ring 13 when there is no battery 17 received in the cylindrical tube 14 of the flashlight. Therefore, the conventional switch mechanism cannot be used as an independent switching device.

SUMMARY OF THE INVENTION

An object of the present invention is to provide a flashlight having a switch mechanism which can overcome the disadvantages that are commonly associated with the conventional switch mechanism described beforehand.

According to the present invention, a flashlight comprises a cylindrical tube with front and rear ends, and a switch mechanism. The switch mechanism includes:

an end cap having a front threaded portion with internal and external threads, the external thread of the front threaded portion of the end cap being threadedly engaged in the rear end of the cylindrical tube;

a contact member having an annular portion and a number of leg portions extending axially from an outer periphery of the annular portion in a direction;

a plunger cylinder having a number of grooves formed on an outer peripheral surface thereof and axially extending from a front end to a rear end thereof corresponding to the leg portions of the contact member, a front threaded portion with an external thread which engages the internal thread of the front threaded portion of the end cap, a number of notches axially formed in the front threaded portion of the plunger cylinder and corresponding to the grooves so that the annular portion of the contact member can be disposed in the front threaded portion of the plunger cylinder with each of the leg portions of the contact member being received in a corresponding one of the grooves via a corresponding one of the notches of the plunger cylinder, and an even number of guide elements formed adjacent to the rear end of the plunger cylinder on an internal face of the plunger cylinder, each of the guide elements being formed with a front cam surface, the plunger cylinder being fitted in the end cap with the leg portions of the contact member contacting electrically an internal surface of the end cap;

a driving assembly having a guide, a first spring member and a plunger, the guide having an even number of guide blocks and a first cam surface formed on a front end thereof, the guide being slidable in the plunger cylinder with a rear end thereof protruding out of the rear end of the plunger cylinder into the end cap, the guide further having a cavity formed in the front end thereof in order to receive the first spring member, the plunger having a plurality of ribs and a second cam surface, the plunger being slidable in the cavity of the guide such that the first cam surface of the guide is engageable with the second cam surface of the plunger, the first spring member biasing a front end of the plunger to pass through the annular portion of the contact member;

a depressing assembly having a button and a second spring member, the button being frictionally disposed in the rear end of the end cap and having a front end engaging the rear end of the guide and a rear end which protrudes out of the rear end of the end cap, the second spring being disposed between the button and the plunger cylinder;

a hollow cylindrical retainer having front and rear ends, a pair of projections which are formed at the rear end of the retainer and which engage two of the notches of the plunger cylinder so that the annular portion of the contact member is sandwiched between the rear end of the retainer and the front end of the plunger cylinder in order to hold the contact member in position; and a third spring member received in the retainer and having front, middle and rear sections, the middle section having a diameter which is larger than those of the front and rear sections so that the middle section can be prevented from being removed from the retainer through the front end of the retainer, the rear section engaging the annular portion of the contact member and the front end of the plunger in order to bias the rear end of the plunger to abut against the second spring member, the front section protruding out of the front end of the retainer;

the driving assembly being pushed to overcome a biasing force of the third spring member by depressing the button of the depressing assembly, and the second cam surface of the plunger being engageable with the front cam surfaces of the plunger cylinder so that the third spring member can contact the contact member in order to turn on and turn off the flashlight.

BRIEF DESCRIPTION OF THE DRAWINGS

Other features and advantages of this invention will become apparent in the following detailed description of the preferred embodiments of this invention with reference to the accompanying drawings, in which:

FIG. 8 is a sectional view of a switch mechanism of the preferred embodiment of the flashlight according to the present invention, in which the flashlight is turned on;

DETAILED DESCRIPTION OF THE PREFERRED EMBODIMENTS

Figure 1:
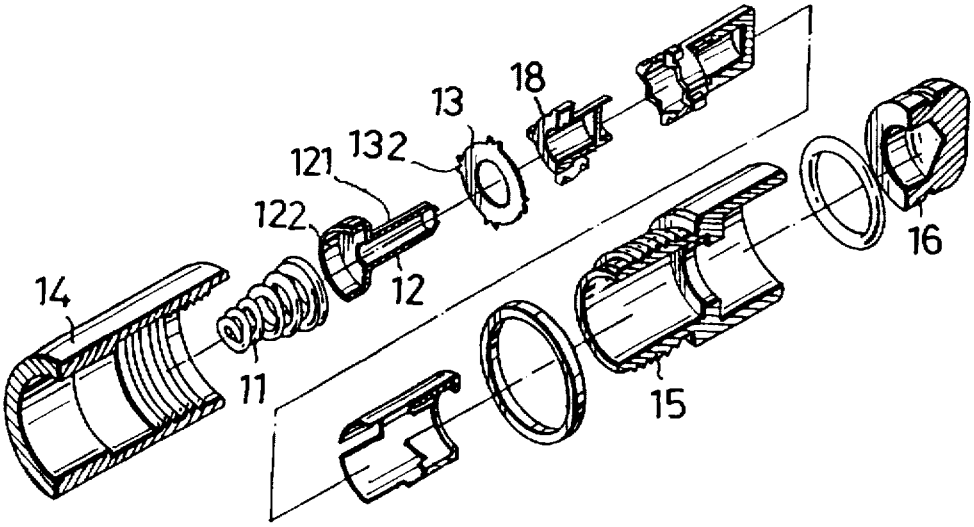
FIG. 1 PRIOR ART
FIG. 1 is an exploded view of a conventional switch mechanism for a flashlight.
Figure 2:
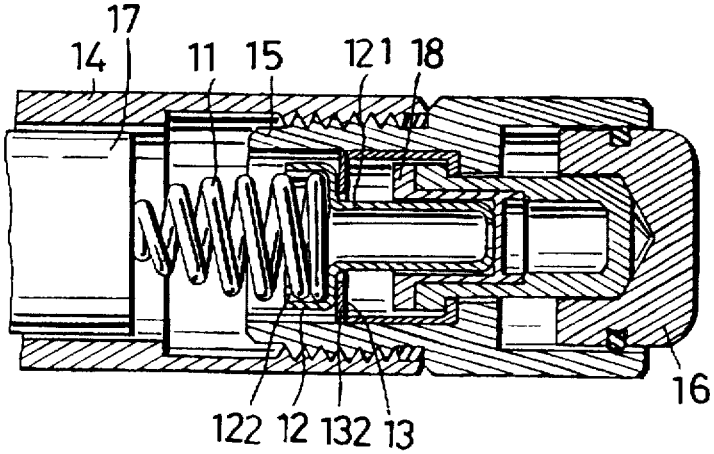
FIG. 2 PRIOR ART
FIGS. 2 to 6 are schematic sectional view illustrating how the conventional switch mechanism of FIG. 1 is operated to turn on and turn off the flashlight.
Figure 3:
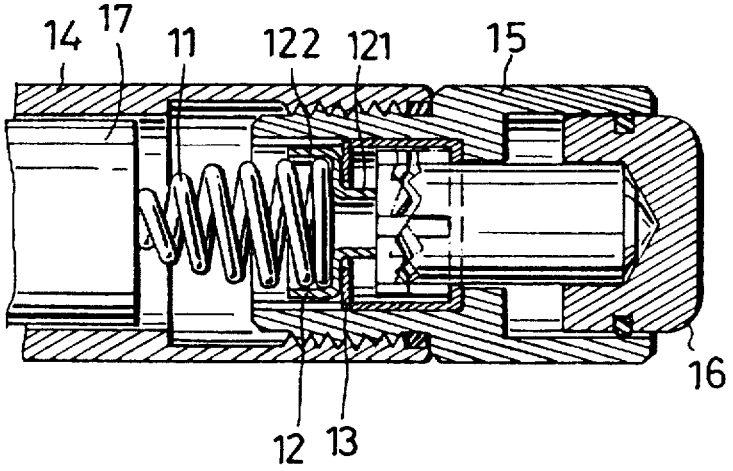
FIG. 3 PRIOR ART
Figure 4:
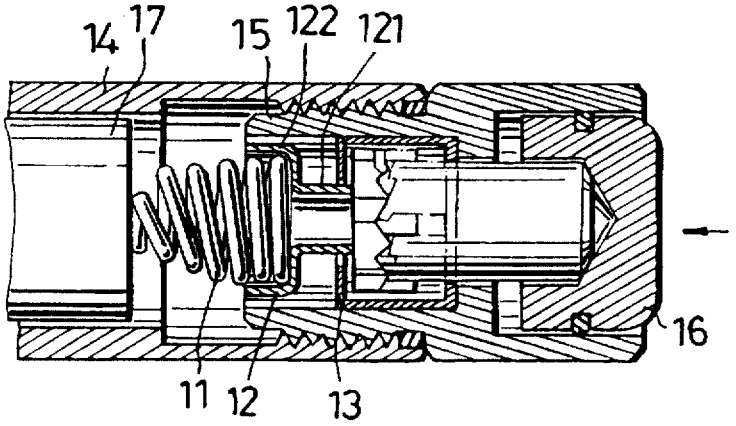
FIG. 4 PRIOR ART
Figure 5:
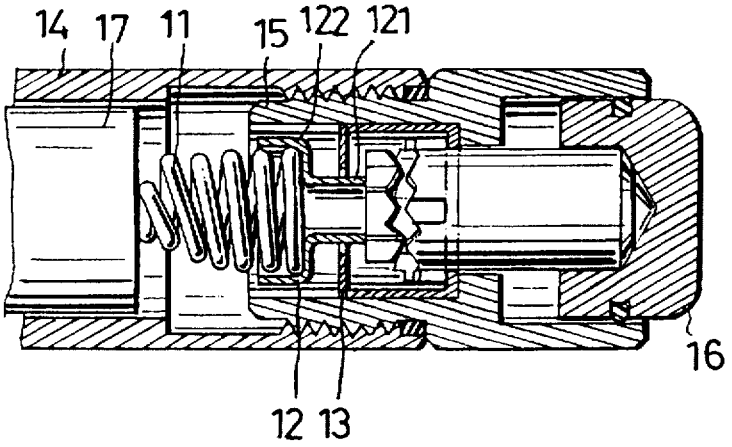
FIG. 5 PRIOR ART
Figure 6:
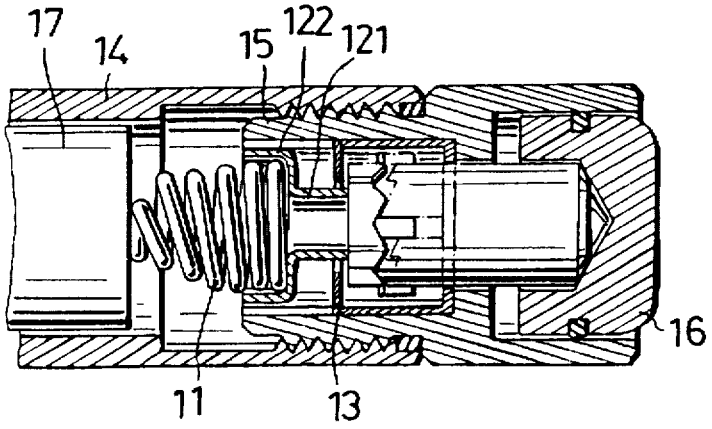
FIG. 6 PRIOR ART
Figure 7:
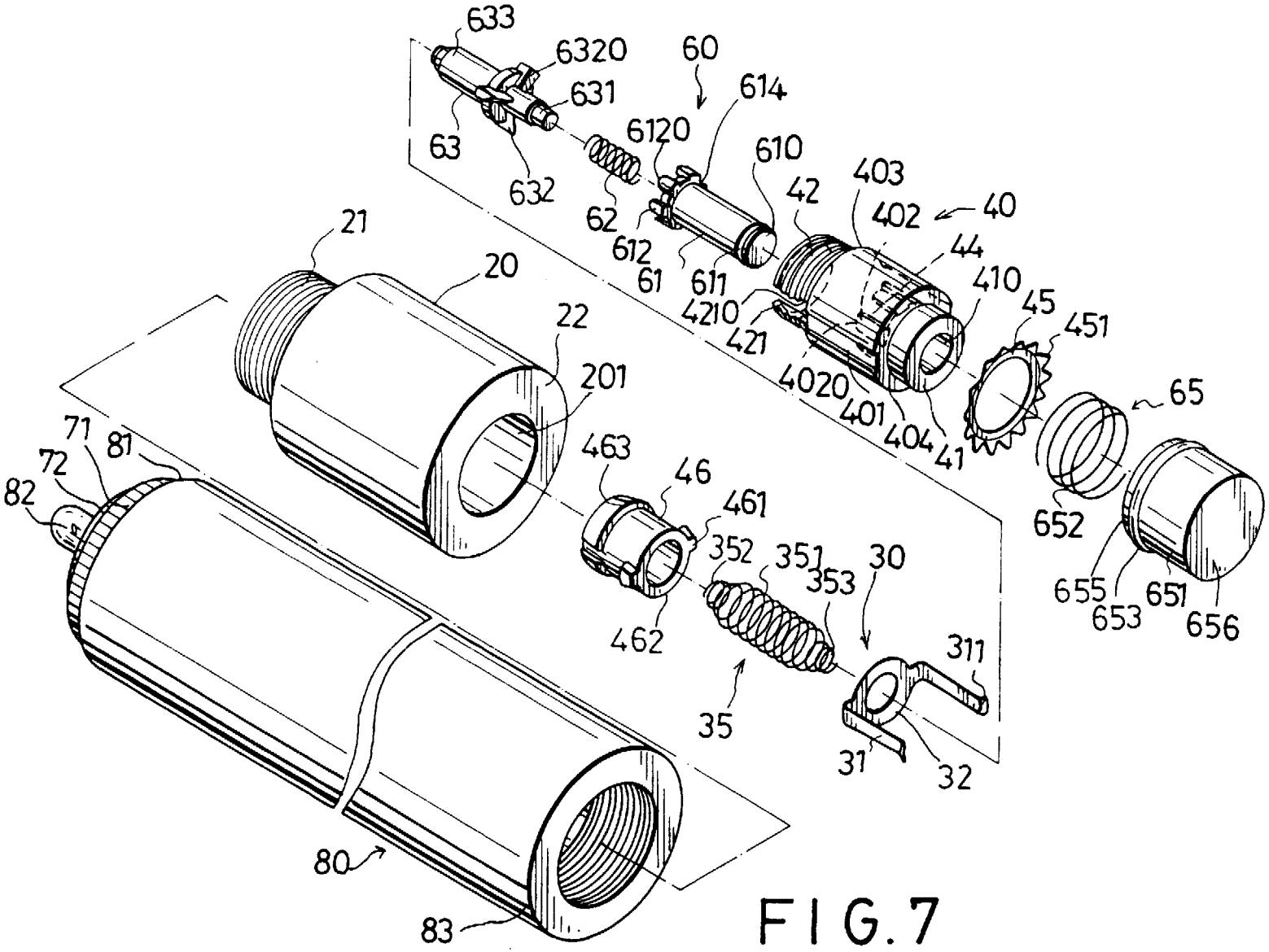
FIG. 7 is an exploded view of a preferred embodiment of a flashlight according to the present invention.

Referring to FIG. 7, a preferred embodiment of a flashlight according to the present invention is shown to comprise a cylindrical tube 80 with front and rear ends 81, 83, and a switch mechanism. The switch mechanism includes an end cap 20, a contact member 30, a plunger cylinder 40, an annular ring 45, a driving assembly 60, a depressing assembly 65, and a hollow cylindrical retainer 46.

Figure 9:
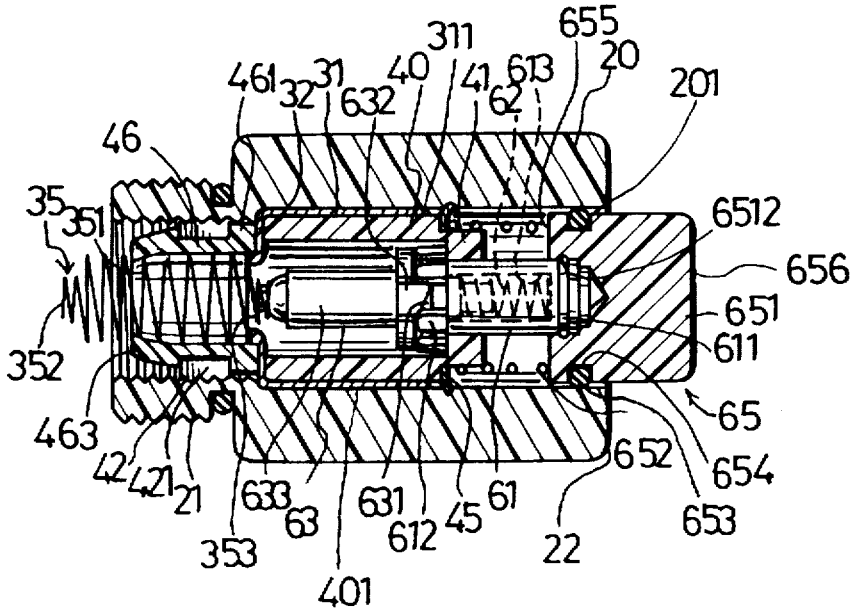
FIG. 9 is a sectional view of the switch mechanism, in which the flashlight is shut off.

Referring to FIGS. 7 and 9, the end cap 20 has a front threaded portion 21 with internal and external threads. The external thread of the front threaded portion 21 is threadedly engaged in the rear end 83 of the cylindrical tube 80.

The contact member 30 has an annular portion 32 and two leg portions 31 extending axially from an outer periphery of the annular portion 32 in the same direction. Each of the leg portions 31 of the contact member 30 has a flared end 311.

The plunger cylinder 40 has two grooves 401 formed in the outer peripheral surface thereof and axially extending from a front end 403 to a rear end 404 thereof corresponding to the leg portions 31 of the contact member 30. The rear end 404 of the plunger cylinder 40 has a diameter-reduced portion 41 formed thereon. It is noted that the inside diameter of the central hole 410 of the diameter-reduced portion 41 is smaller than that of the plunger cylinder 40. The front end 403 of the plunger cylinder 40 has a front threaded portion 42 with an external thread formed thereon. The external thread of the front threaded portion 42 engages the internal thread of the front threaded portion 21 of the end cap 20. Two notches 421 are formed axially in the front threaded portion 42 and correspond to the grooves 401 so that the annular portion 32 of the contact member 30 can be disposed in the front threaded portion 42 of the plunger cylinder 40 with each of the leg portions 31 being received in a corresponding one of the grooves 401 via a corresponding one of the notches 421 of the plunger cylinder 40, as best illustrated in FIG. 9. Each of the notches 421 has a dovetail-shaped bottom portion 4210 formed adjacent to the front end 403 of the plunger cylinder 40. An even number of guide elements 402 are formed adjacent to the rear end 404 of the plunger cylinder 40 on the internal face of the plunger cylinder 40. Each of the guide elements 402 is formed with a front cam surface 4020. An axially extending recess 44 is formed between every two of the guide elements 402. The plunger cylinder 40 is fitted in the end cap 20 with the flared ends 311 of the leg portions 31 of the contact member 30 being in electrical contact with an internal surface of the end cap 20.

The annular ring 45 has a number of sharpened protrusions formed on an outer peripheral surface thereof. The sharpened protrusions extend rearward and inclinedly and are forced into the end cap 20 in order to retain the plunger cylinder 40 in the end cap 20.

Figure 8:
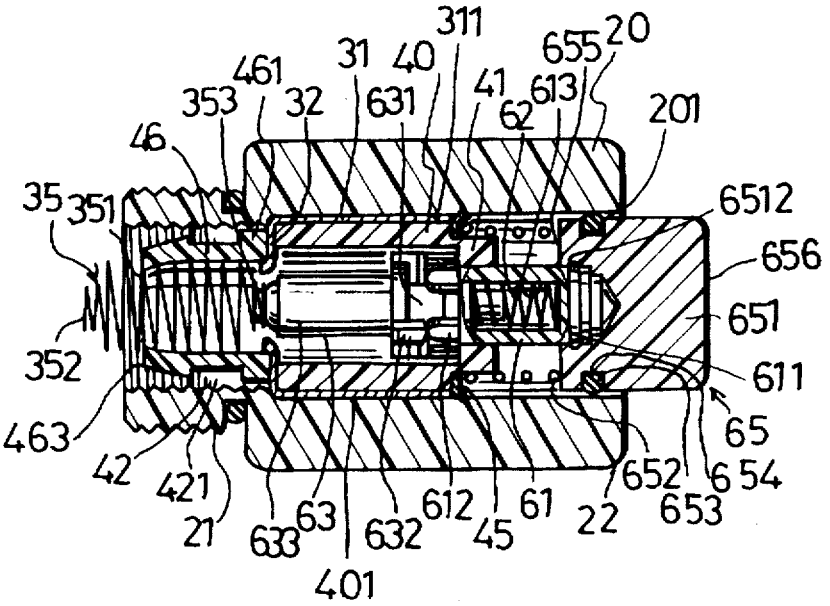

The driving assembly 60 has a guide 61, a first spring member 62 and a plunger 63. An even number of radially and outwardly extending guide blocks 612 are formed on a front end 614 of the guide 61 and form a series of axially extending first cam surfaces 6120. The guide 61 is slidable in the plunger cylinder 40 with a rear end 610 thereof protruding out of the rear end 404 through the central hole 410 of the diameter-reduced portion 41 of the plunger cylinder 40 into the end cap 20. The rear end 610 of the guide 61 is provided with an annular rib 611. The guide 61 further has a cavity 613 formed in the front end 614 thereof in order to receive the first spring member 62. The plunger 63 has an even number of radially and outwardly extending ribs 632 formed near a diameter-reduced rear end 631. Each of the ribs 632 has a second cam surface 6320 formed on a rear peripheral surface thereof. The plunger 63 is slidable in the cavity 613 of the guide 61 such that the first cam surface 6120 of the guide 61 is engageable with the second cam surface 6320 of the plunger 63. The guide blocks 612 are as wide as the ribs 632 of the plunger 63 so that the guide blocks 612 and the ribs 632 are receivable within the recesses 44 of the plunger cylinder 40. The diameter of the rear end 631 of the plunger 63 is such that the rear end 631 is rotatable and slidable within the cavity 613 of the guide 61 and is engageable with a front end of the first spring member 62, as best illustrated in FIGS. 8 and 9. The diameter of a front end 633 of the plunger 63 is such that the front end 633 is extensible through the annular portion 32 of the contact member 30 and is retractable into plunger cylinder 40 when the driving assembly 60 is depressed by the depressing assembly 65.

The depressing assembly 65 has a button 651 and a second spring member 652. The button 651 is cup-shaped and has an annular groove 654 on an outer surface thereof for receiving a sealing ring 653 so that the button 651 is frictionally disposed in the rear end of the end cap 20. An annular recess 6512 is formed in an internal wall adjacent to a front end 655 of the button 651 and engages the annular rib 611 of the guide 61 so that the guide 61 can be moved with the button 651. A rear end 656 of the button 651 protrudes out of the rear end 22 of the end cap 20. The second spring member 652 is disposed between the front end 655 of the button 651 and the rear end 404 of the plunger cylinder 40.

The retainer 46 has two radially and outwardly extending dovetail-shaped projections 461 formed diametrically at a rear end 462 thereof. The projections 461 engage correspondingly the dovetail-shaped bottom portions 4210 of the notches 421 of the plunger cylinder 40 so that the retainer 46 is connected fixedly to the plunger cylinder 40. The annular portion 32 of the contact member 30 is sandwiched between the rear end 462 of the retainer 46 and the front end 403 of the plunger cylinder 40, thereby holding the contact member 30 in position.

A third spring member 35 is received in the retainer 46 and is a coiled spring with front, middle and rear sections 352, 351 and 353. The diameter of the middle section 351 is larger than those of the front and rear sections 352 and 353 so that the middle section 351 can prevent removal of the third spring member 35 from the retainer 46 through the front end 463 of the retainer 46. The rear section 353 engages the annular portion 32 of the contact member 30 and the front end 633 of the plunger 63. The front section 353 protrudes out of the front end 463 of the retainer 46 and may be connected electrically to a battery to be received in the cylindrical tube 80 in order to turn on the flashlight.

It is noted that the button 651, the plunger cylinder 40, the guide 61, the plunger 63 are made of an electrically non-conductive material.

Referring to FIGS. 8 and 9, the operation of the switch mechanism for a flashlight in accordance with the present invention will now be described. As shown in FIG. 9, the front section 352 protrudes out of the front end 463 of the retainer 46 and is connected electrically to the cathode of the rearmost battery (not shown) in the cylindrical tube 80 when the front threaded portion 21 of the end cap 20 is engaged threadedly in the rear end 83 of the cylindrical tube 80. The rear section 353 of the third spring member 35 is connected electrically to the contact member 30 which, in turn, is connected electrically to the anode of the frontmost battery (not shown) through the end cap 20 and the cylindrical tube 80. At this moment, each rib 632 and each guide block 612 are received in a respective recess 44 of the plunger cylinder 40.

If it is desired to turn off the flashlight, it is necessary only that the button 651 be depressed lightly so that the button 651 pushes the driving assembly 60 to overcome the biasing force of the third spring member 35. The plunger 63 and the guide 61 are pushed forward by the button 651. When the button 651 is depressed such that the second cam surfaces 6320 of the ribs 632 extend out of the recesses 44, the second cam surfaces 6320 are forced to slide sideways and are held by the front cam surfaces 4020 of the guide elements 402 by the third spring member 35. The rear section 353 of the third spring member 35 is thus separated from the annular portion 32 of the contact member 30 and the flashlight is turned off, as best illustrated in FIG. 8.

If it is desired to turn on the flashlight, it is necessary only to further depress the button 651 until the second cam surfaces 6320 of the ribs 632 extend from the front cam surfaces 4020 of the guide elements 402 so that the second cam surfaces 6320 of the ribs 632 slide along the front cam surfaces 4020 of the guide elements 402 and slide back into the recesses 44 of the plunger cylinder 40. The rear section 353 of the third spring member 35 is thus connected electrically with the annular portion 32 of the contact member 30, as best illustrated in FIG. 9.

It is noted that the switch mechanism can be positively operated in order to turn on or turn off the flashlight without undesired electrical contact of third spring member 35 and the contact member 30 in accordance with the present invention. Also, note that the switch mechanism can be employed as an independent switching device by connecting negative and positive poles of an electric power source in an electric circuit electrically and respectively to the front section 352 and the end cap 20.

Figure 10:
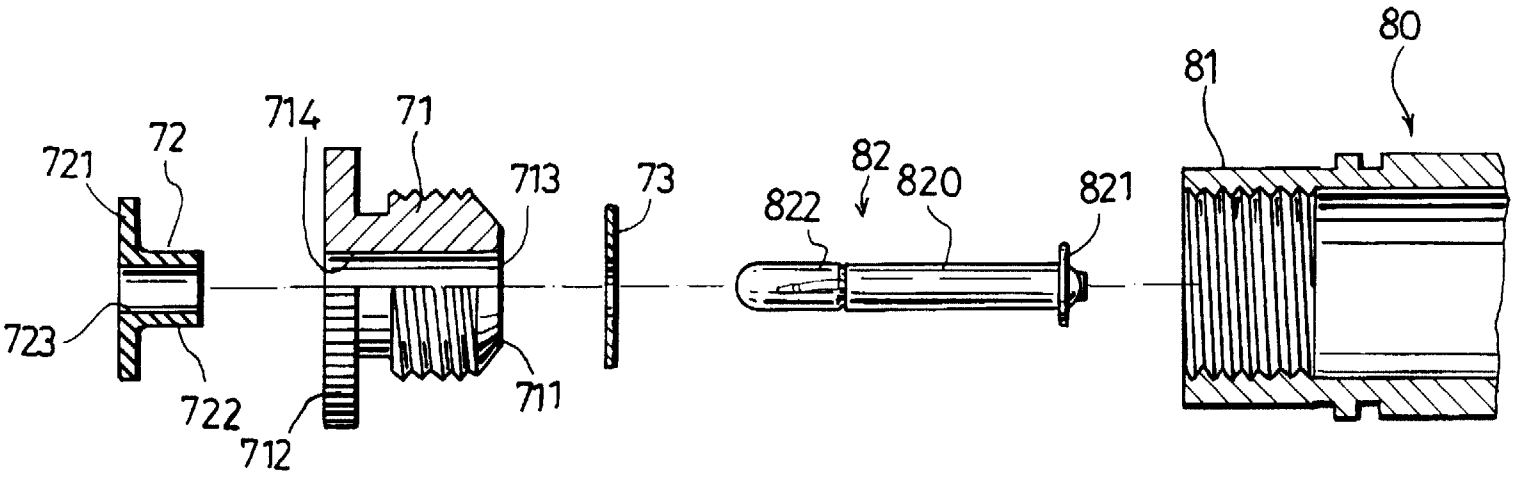
FIG. 10 is an exploded view illustrating a preferred embodiment of a bulb assembly which includes a bulb, a bulb seat, and an insulating member and which is mounted to the front end of the flashlight according to the present invention.
Figure 11:
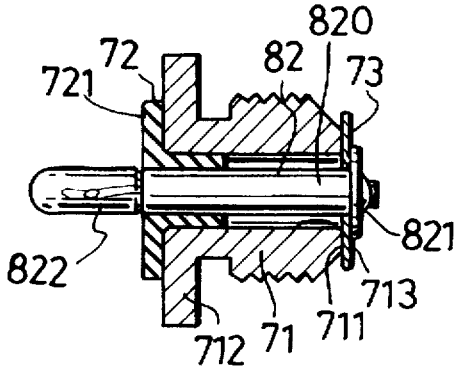
FIG. 11 is a sectional view illustrating the bulb, the bulb seat, and the insulating member of the bulb assembly being assembled according to the present invention.

Referring to FIG. 10, a bulb assembly is mounted to the front end 81 of the cylindrical tube 80. The bulb assembly comprises a bulb 82, a conductive ring 73, a conductive bulb seat 71 and an insulating member 72. The bulb 82 has a conductive section 820 with a radial flange 821 and an illuminating section 822. The bulb seat 71 has a central through hole 713, a front end 714 with a radial flange 712 extending outwardly therefrom, and a rear end 711 which is engaged threadedly in the front end 81 of the cylindrical tube 80. The insulating member 72 has a tubular portion 722 and a radial flange 721 extending outwardly from an end 723 of the tubular portion 722. The conductive section 820 of the bulb 82 extends through the conductive ring 73 and the central through hole 713 of the bulb seat 71 so that the illuminating section 822 protrudes out of the front end 714 of the bulb seat 71 and the conductive ring 73 is sandwiched between the rear end 711 of the bulb seat 71 and the radial flange 821 of the bulb 82, as best illustrated in FIG. 11. Therefore, the conductive section 820 of the bulb 82 can contact electrically and positively the bulb seat 71. The tubular portion 722 of the insulating member 72 is inserted into the central through hole 713 of the bulb seat 71 and is sleeved around the conductive section 820 of the bulb 82 with the radial flange 721 abutting the radial flange 712 of the bulb seat 71 in order to hold the bulb 82 in position. The configuration of the bulb assembly is relatively simple and can be easily manufactured and assembled.

Figure 12:
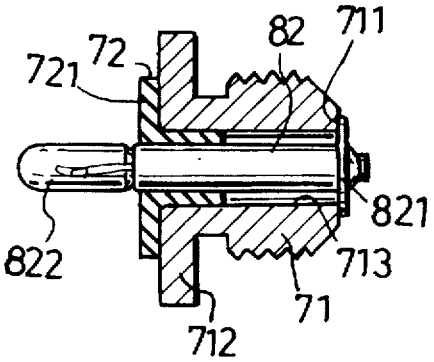
FIG. 12 is a sectional view of another preferred embodiment of a bulb assembly which is mounted to the front end of the flashlight according to the present invention.

FIG. 12 shows a modification of the bulb assembly of FIG. 11. As shown, the radial flange 821 of the bulb 82 contacts directly the rear end 711 of the bulb seat 71, thus eliminating the conductive ring 73 of FIG. 11.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangement.

I claim:

1. A flashlight comprising a cylindrical tube with front and rear ends, and a switch mechanism, said switch mechanism including:

an end cap having a front threaded portion with internal and external threads, said external thread of said front threaded portion of said end cap being threadedly engaged in said rear end of said cylindrical tube;

a contact member having an annular portion and a number of leg portions extending axially from an outer periphery of said annular portion in a direction;

a plunger cylinder having a number of grooves formed on an outer peripheral surface thereof and axially extending from a front end to a rear end thereof corresponding to said leg portions of said contact member, a front threaded portion with an external thread which engages said internal thread of said front threaded portion of said end cap, a number of notches axially formed in said front threaded portion of said plunger cylinder and corresponding to said grooves so that said annular portion of said contact member can be disposed in said front threaded portion of said plunger cylinder with each of said leg portions of said contact member being received in a corresponding one of said grooves via a corresponding one of said notches of said plunger cylinder, and an even number of guide elements formed adjacent to said rear end of said plunger cylinder on an internal face of said plunger cylinder, each of said guide elements being formed with a front cam surface, said plunger cylinder being fitted in said end cap with said leg portions of said contact member contacting electrically an internal surface of said end cap;

a driving assembly having a guide, a first spring member and a plunger, said guide having an even number of guide blocks and a first cam surface formed on a front end thereof, said guide being slidable in said plunger cylinder with a rear end thereof protruding out of said rear end of said plunger cylinder into said end cap, said guide further having a cavity formed in said front end thereof in order to receive said first spring member, said plunger having a plurality of ribs and a second cam surface, said plunger being slidable in said cavity of said guide such that said first cam surface of said guide is engageable with said second cam surface of said plunger, said first spring member biasing a front end of said plunger to pass through said annular portion of said contact member;

a depressing assembly having a button and a second spring member, said button being frictionally disposed in said rear end of said end cap and having a front end engaging said rear end of said guide and a rear end which protrudes out of said rear end of said end cap, said second spring member being disposed between said button and said plunger cylinder;

a hollow cylindrical retainer having front and rear ends, a pair of projections which are formed at said rear end of said retainer and which engage two of said notches of said plunger cylinder so that said annular portion of said contact member is sandwiched between said rear end of said retainer and said front end of said plunger cylinder in order to hold said contact member in position; and a third spring member received in said retainer and having front, middle and rear sections, said middle section having a diameter which is larger than those of said front and rear sections so that said middle section can be prevented from being removed from said retainer through said front end of said retainer, said rear section engaging said annular portion of said contact member and said front end of said plunger in order to bias said rear end of said plunger to abut against said second spring member, said front section protruding out of said front end of said retainer;

said driving assembly being pushed to overcome a biasing force of said third spring member by depressing said button of said depressing assembly, and said second cam surface of said plunger being engageable with said front cam surfaces of said plunger cylinder so that said third spring member can contact said contact member in order to turn on and turn off said flashlight.

2. The flashlight as claimed in claim 1, wherein each of said leg portions of said contact member has a flared end.

3. The flashlight as claimed in claim 1, wherein each of notches of said plunger cylinder has a dovetail-shaped bottom portion formed adjacent to said front end of said plunger cylinder, and said projections of said retainer being a pair of dovetail-shaped projections.

4. The flashlight as claimed in claim 1, wherein said button is cup-shaped and has an annular recess formed in an internal wall of said button adjacent to said front end of said button, said rear end of said guide having an annular rib which engages correspondingly said annular recess in said button.

5. The flashlight as claimed in claim 1, further comprising an annular ring having a number of sharpened protrusions formed on an outer peripheral surface thereof, said sharpened protrusions being forced into said end cap in order to retain said plunger cylinder in said end cap.

6. The flashlight as claimed in claim 1, further comprising a bulb, a conductive bulb seat and an insulating member, said bulb having a conductive section with a radial flange and an illuminating section, said bulb seat having a central through hole, a front end with a radial flange extending outwardly therefrom, and a rear end which is engaged threadedly in said front end of said cylindrical tube, said insulating member having a tubular portion and a radial flange extending outwardly from an end of said tubular portion, said conductive section of said bulb extending through said central through hole of said bulb seat with said illuminating section protruding out of said front end of said bulb seat and with said radial flange of said bulb contacting said rear end of said bulb seat, said tubular portion being inserted into said central through hole of said bulb seat and being sleeved around said conductive section of said bulb with said radial flange of said insulating member abutting against said radial flange of said bulb seat in order to hold said bulb in position.

7. The flashlight as claimed in claim 6, further comprising a conductive ring which is passed through by said bulb and which is sandwiched between said rear end of said bulb seat and said radial flange of said bulb.

* * * * *